US008826666B2

(12) United States Patent
Kajimura et al.

(10) Patent No.: US 8,826,666 B2
(45) Date of Patent: Sep. 9, 2014

(54) NOZZLE, AND GAS TURBINE COMBUSTOR HAVING THE NOZZLE

(75) Inventors: Shuhei Kajimura, Tokyo (JP); Keijiro Saito, Tokyo (JP); Satoshi Takiguchi, Tokyo (JP); Mitsuhiro Nakao, Tokyo (JP); Koichi Nishida, Tokyo (JP); Shinji Akamatsu, Tokyo (JP); Sosuke Nakamura, Tokyo (JP); Masaki Mitani, Tokyo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 13/882,655

(22) PCT Filed: Mar. 30, 2012

(86) PCT No.: PCT/JP2012/058593

§ 371 (c)(1),
(2), (4) Date: Sep. 4, 2013

(87) PCT Pub. No.: WO2012/133774

PCT Pub. Date: Oct. 4, 2013

(65) Prior Publication Data

US 2014/0041389 A1 Feb. 13, 2014

(30) Foreign Application Priority Data

Mar. 30, 2011 (JP) ..... 2011-076019

(51) Int. Cl.

| | |
|---|---|
| ***F02C 1/00*** | (2006.01) |
| ***F23R 3/34*** | (2006.01) |
| ***F23R 3/28*** | (2006.01) |
| ***F23D 14/24*** | (2006.01) |
| ***F23R 3/14*** | (2006.01) |

(52) U.S. Cl.

CPC ..... *F23R 3/28* (2013.01); *F23C 2900/07021* (2013.01); *F23R 3/343* (2013.01); *F23R 3/283* (2013.01); *F23D 14/24* (2013.01); *F23R 3/14* (2013.01); *F23D 2900/00014* (2013.01); *F23D 2900/00016* (2013.01)

USPC ..... 60/740; 60/748

(58) Field of Classification Search

CPC ..... F23C 2900/07021; F23D 14/24; F23D 2900/00014; F23D 2900/00016; F23R 3/14; F23R 3/28; F23R 3/283; F23R 3/343

USPC ..... 60/737, 740, 742, 746–748

See application file for complete search history.

(56) References Cited

U.S. PATENT DOCUMENTS 3,735,930 A * 5/1973 Mori ..... 239/419.5
4,070,826 A * 1/1978 Stenger et al. ..... 60/748

(Continued)

FOREIGN PATENT DOCUMENTS

JP 6-065750 U 9/1994
JP 9-137946 A 5/1997

(Continued)

OTHER PUBLICATIONS

International Search Report for PCT/JP2012/058593, mailing date of Apr. 24, 2012.

Written Opinion of PCT/JP2012/058593, mailing date of Apr. 24, 2012.

*Primary Examiner* — Phutthiwat Wongwian

(74) *Attorney, Agent, or Firm* — Westerman, Hattori, Daniels & Adrian, LLP

(57) ABSTRACT

A pilot nozzle, a gas turbine combustor and a gas turbine are provided with a nozzle main body having a fuel passage, a cover ring arranged at an outside of a front end-outer peripheral portion of the nozzle main body at a predetermined interval to form an inner air passage and capable of injecting air toward a front side of the nozzle main body, a plurality of nozzle tips that includes a fuel injection nozzle attached to a front end portion of the cover ring at a predetermined interval in a circumferential direction to communicate with the fuel passage and is able to inject fuel toward an outside of injection air from the inner air passage, and a swirling force application unit that applies a swirling force to air injected through the inner air passage.

8 Claims, 8 Drawing Sheets

(56) References Cited

U.S. PATENT DOCUMENTS

| | | | | |
|---|---|---|---|---|
| 4,229,944 | A * | 10/1980 | Weiler | 60/740 |
| 6,267,583 | B1 | 7/2001 | Mandai et al. | |
| 6,460,326 | B2 * | 10/2002 | Bechtel et al. | 60/39.465 |
| 6,786,046 | B2 * | 9/2004 | Wiebe et al. | 60/737 |
| 7,694,521 | B2 * | 4/2010 | Ohta et al. | 60/748 |
| 7,861,528 | B2 * | 1/2011 | Myers et al. | 60/737 |
| 2012/0055162 | A1 * | 3/2012 | Eroglu et al. | 60/740 |
| 2012/0180490 | A1 * | 7/2012 | Takami et al. | 60/740 |

FOREIGN PATENT DOCUMENTS

| | | | |
|---|---|---|---|
| JP | 2000-039147 | A | 2/2000 |
| JP | 2000-039148 | A | 2/2000 |
| JP | 2005-106411 | A | 4/2005 |
| JP | 2009-168397 | A | 7/2009 |
| JP | 2010-159757 | A | 7/2010 |

* cited by examiner

NOZZLE, AND GAS TURBINE COMBUSTOR HAVING THE NOZZLE

FIELD

The present invention relates to a nozzle that performs diffusive combustion, a gas turbine combustor having the nozzle, and a gas turbine provided with the gas turbine combustor.

BACKGROUND

A general gas turbine includes a compressor, a combustor, and a turbine. Further, the compressor compresses air introduced from an air inlet opening to provide high-temperature and high-pressure compression air, and the combustor combusts the compression air with a fuel supplied to the compression air, thereby obtaining the high-temperature and high-pressure combustion gas (a working fluid). The turbine is driven by the combustion gas to drive a generator connected to the turbine.

A conventional gas turbine combustor is configured such that a plurality of main combustion burners is arranged to surround around a pilot combustion burner, a pilot nozzle is incorporated into the pilot combustion burner, a main nozzle is incorporated into the main combustion burner, and the pilot combustion burner and the plurality of main combustion burners are arranged within an inner cylinder of a gas turbine.

Examples of such gas turbine combustor are disclosed in Patent Literatures 1 and 2. A gas turbine combustor described in Patent Literature 1 is configured with a pilot nozzle. The pilot nozzle is provided with a sleeve arranged at an outside of a main body forming a fuel passage, a cover ring arranged between the sleeve and the main body to form inner and outer air passages, and a nozzle tip 75 having a fuel injection nozzle communicating with the fuel passage and provided at a front end side of the cover ring. In addition, a gas turbine combustor described in Patent Literature 2 is configured such that a fuel nozzle is provided with a diffusion tip through which fuel or air, or a fuel-air mixture passes and which serves as a passage together with a main premixed circuit.

CITATION LIST

Patent Literature

Patent Literature 1: Japanese Patent Application Laid-open No. 2009-168397

Patent Literature 2: Japanese Patent Application Laid-open No. 2010-159757

SUMMARY

Technical Problem

In the conventional gas turbine combustor described above, an air-fuel mixture of the air and the fuel injected from the main nozzle becomes a swirling flow (a hot gas), and is re-circulated toward a front end portion of the pilot nozzle, so that the air-fuel mixture collides with an air flow injected from the pilot nozzle, and is combusted to form a flame. In this case, the air flow injected from the pilot nozzle is fluctuated by variations in flow amount and so on. When the air flow from the pilot nozzle decreases, a large amount of circulatory flows of the air-fuel mixture flows toward the pilot nozzle, so that a temperature increases. Thus, the front end portion of the pilot nozzle may be damaged, and a NOx generation amount also increases. Meanwhile, when an air amount from the pilot nozzle increases, a velocity distribution within a pilot cone greatly changes, and thus combustion becomes unstable.

In order to solve the problems described above, an object of the present invention is to provide a nozzle, a gas turbine combustor, and a gas turbine, capable of suppressing a NOx generation amount and preventing the nozzle from being damaged by controlling a cooling air amount or a velocity distribution.

Solution to Problem

According to a nozzle of the present invention in order to achieve the object, it is characterized that the nozzle includes: a nozzle main body having a fuel passage; a cover ring arranged at an outside of a front end-outer peripheral portion of the nozzle main body at a predetermined interval to form an inner air passage and capable of injecting air toward a front side of the nozzle main body; fuel injection nozzles attached to a front end portion of the cover ring at a predetermined interval in a circumferential direction to communicate with the fuel passage; and a swirling force application unit that applies a swirling force to air injected through the inner air passage.

Accordingly, since the air injected toward the front side of the nozzle main body from the cover ring through the inner air passage becomes a swirling flow by the swirling force application unit, even when the air flow amount is varied, it is possible to stabilize combustion without largely fluctuating an air flow velocity distribution in an axial direction. In addition, by suppressing a temperature rise in the vicinity of the nozzle, it is possible to prevent the front end portion of the nozzle from being damaged, and it is possible to reduce a NOx generation amount. As a result, it is possible to accomplish stabilized combustion.

According to the nozzle of the present invention, it is characterized that the swirling force application unit has guide portions provided at an outlet of the inner air passage.

Accordingly, since the swirling force application unit is provided as the guide portion formed at the outlet of the inner air passage, the air injected toward the front side of the nozzle main body from the cover ring can easily become the swirling flow.

According to the nozzle of the present invention, it is characterized that the fuel injection nozzles are provided at a plurality of nozzle tips capable of injecting fuel to an outside of injection air from the inner air passage, and the guide portions are provided at the plurality of nozzle tips.

Accordingly, since the guide portion is provided at the plurality of nozzle tips, it is possible to achieve structure simplification.

According to the nozzle of the present invention, it is characterized that the fuel injection nozzles are provided at a plurality of nozzle tips capable of injecting fuel to an outside of injection air from the inner air passage, and the guide portions are provided at the plurality of nozzle tips.

Accordingly, it is possible to facilitate mixing of the swirling flow of the air injected from the cover ring and the fuel injected from the nozzle tips.

According to the nozzle of the present invention, it is characterized that a sleeve is arranged at an outside of an outer peripheral portion of the cover ring at a predetermined interval to form an outer air passage and is capable of injecting air toward an outside of injection fuel from the fuel passage.

Accordingly, since the air injected through the inner air passage and the air injected through the outer air passage envelop the injection fuel, it is possible to prompt a mixing of both the air and the fuel and to maintain a fuel-air ratio at an appropriate value.

According to a gas turbine combustor of the present invention, it is characterized that the gas turbine combustor, includes: a combustion chamber that combusts high-pressure air and fuel therein to generate combustion gas; a pilot combustion burner arranged at a central portion within the combustion chamber; and a plurality of main combustion burners arranged to surround the pilot combustion burner within the combustion chamber, wherein the pilot combustion burner includes a pilot cone, a pilot nozzle arranged within the pilot cone, and a swirler vane provided at an outer peripheral portion of the pilot nozzle, and the pilot cone includes a nozzle main body having a fuel passage, a cover ring arranged at an outside of a front end-outer peripheral portion of the nozzle main body at a predetermined interval to form an inner air passage and capable of injecting air toward a front side of the nozzle main body, fuel injection nozzles attached to a front end portion of the cover ring at a predetermined interval in a circumferential direction to communicate with the fuel passage, and a swirling force application unit that applies a swirling force to air flowing through the inner air passage.

Accordingly, in the pilot combustion burner, since the air injected toward the front side of the nozzle main body from the cover ring through the inner air passage becomes the swirling flow by the swirling force application unit, even when the air flow amount is varied, it is possible to stabilize combustion without largely fluctuating the air flow velocity distribution in the axial direction. In addition, by suppressing a temperature rise in the vicinity of the pilot nozzle, it is possible to prevent the front end portion of the pilot nozzle from being damaged and to reduce a NOx generation amount. As a result, it is possible to accomplish stabilized combustion.

According to a gas turbine of the present invention, it is characterized that the gas turbine in which a combustor supplies fuel to compression air compressed by a compressor to combust the fuel, and supplies generated combustion gas to a turbine to obtain a rotational driving force, wherein the combustor includes a combustion chamber that combusts high-pressure air and fuel therein to generate combustion gas, a pilot combustion burner arranged at a central portion within the combustion chamber, and a plurality of main combustion burners arranged to surround the pilot combustion burner within the combustion chamber, the pilot combustion burner includes a pilot cone, a pilot nozzle arranged within the pilot cone, and a swirler vane provided at an outer peripheral portion of the pilot nozzle, and the pilot cone includes a nozzle main body having a fuel passage, a cover ring arranged at an outside of a front end-outer peripheral portion of the nozzle main body at a predetermined interval to form an inner air passage and capable of injecting air toward a front side of the nozzle main body, fuel injection nozzles attached to a front end portion of the cover ring at a predetermined interval in the circumferential direction to communicate with the fuel passage, and a swirling force application unit that applies a swirling force to air flowing through the inner air passage.

Accordingly, in the pilot combustion burner, since the air injected toward the front side of the nozzle main body from the cover ring through the inner air passage becomes the swirling flow by the swirling force application unit, even when the air flow amount is varied, it is possible to stabilize combustion without largely fluctuating the air flow velocity distribution in the axial direction. In addition, by suppressing a temperature rise in the vicinity of the pilot nozzle, it is possible to prevent the front end portion of the pilot nozzle from being damaged and to reduce a NOx generation amount. As a result, it is possible to accomplish stabilized combustion.

Advantageous Effects of Invention

According to a nozzle, a gas turbine combustor, and a gas turbine of the present invention, since a swirling force application unit that applies a swirling force to air injected toward an inside of injection fuel from the nozzle is provided, it is possible to accomplish stabilized combustion and improve turbine efficiency.

BRIEF DESCRIPTION OF DRAWINGS

FIG. 1-2 is a cross-sectional view illustrating an operation of a guide surface of the pilot nozzle of the first embodiment.

FIG. 2 is a cross-sectional view for illustrating the front end portion of the pilot nozzle of the first embodiment at a position where a nozzle tip is not provided.

DESCRIPTION OF EMBODIMENTS

Hereinafter, preferred embodiments of a nozzle, a gas turbine combustor, and a gas turbine according to present invention will be described in detail with reference to the accompanying drawings. The present invention is not limited by the embodiments. In addition, when a plurality of embodiments is presented, the present invention includes configurations in which the respective embodiments are combined with each other.

First Embodiment

Figure 1:
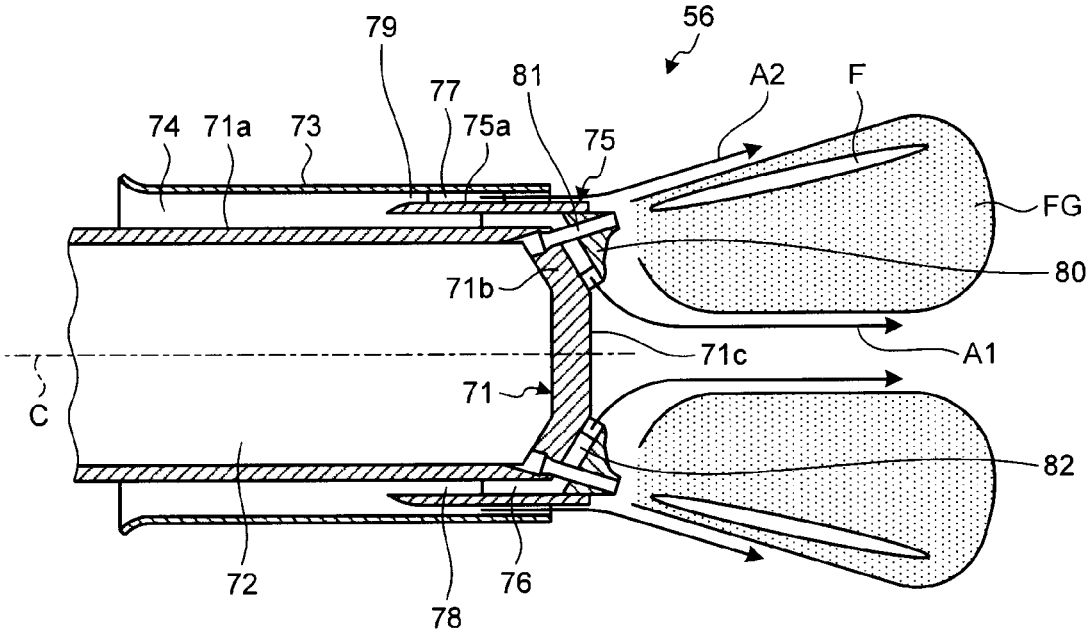
FIG. 1-1 is a cross-sectional view for illustrating a front end portion of a pilot nozzle according to a first embodiment of the present invention at a position where a nozzle tip is provided.
Figures 1, 2:
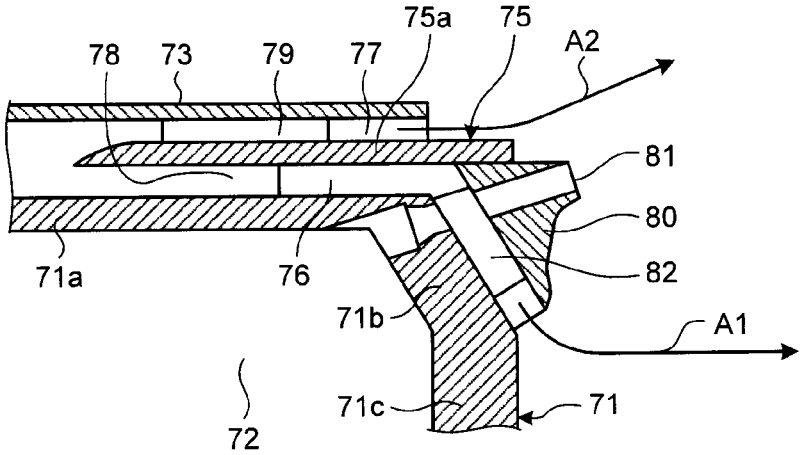
Figure 2:
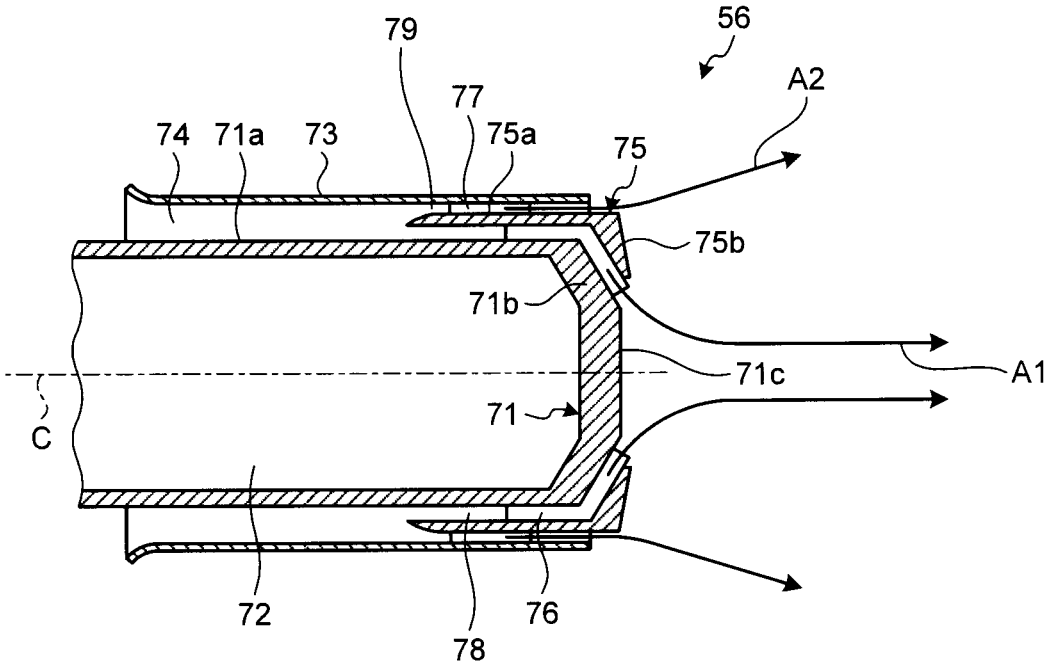
Figure 3:
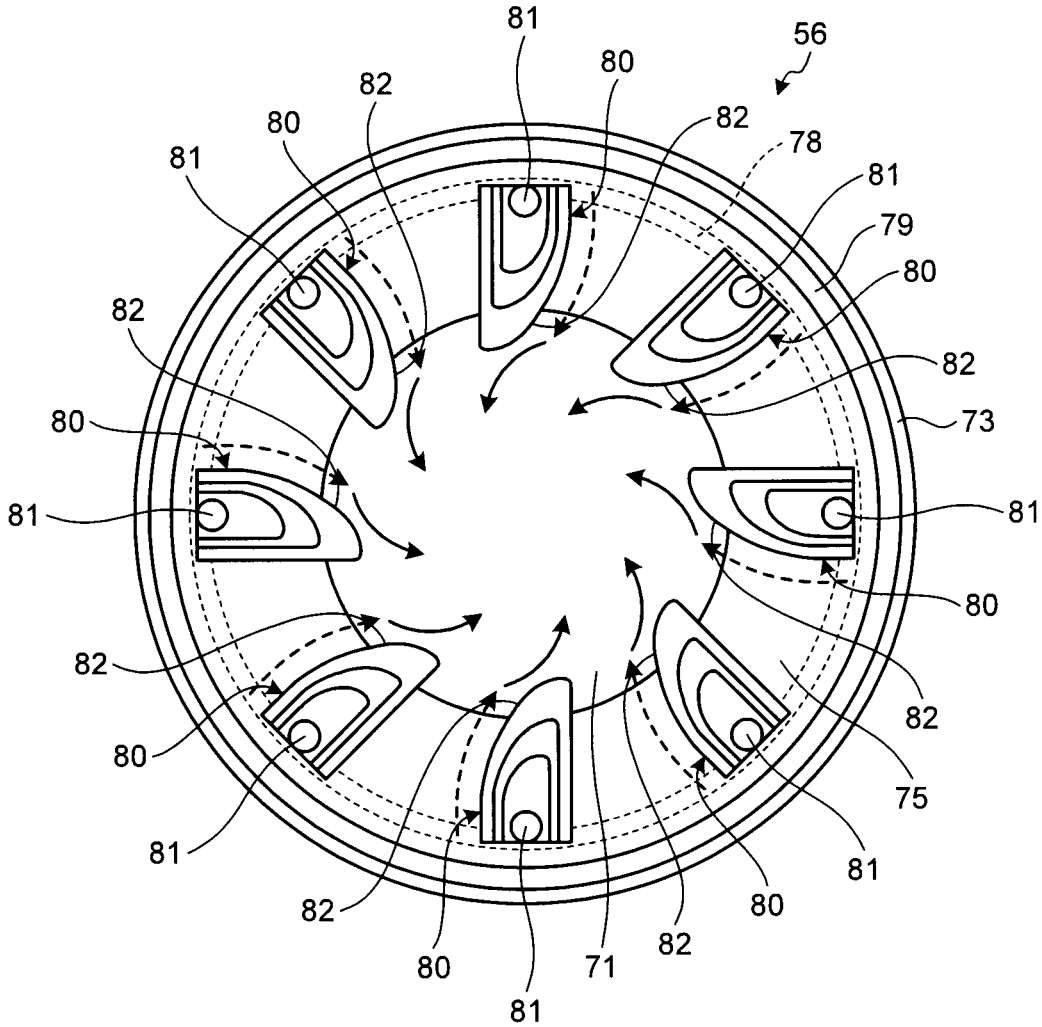
FIG. 3 is a front view illustrating the front end portion of the pilot nozzle of the first embodiment.
Figure 4:
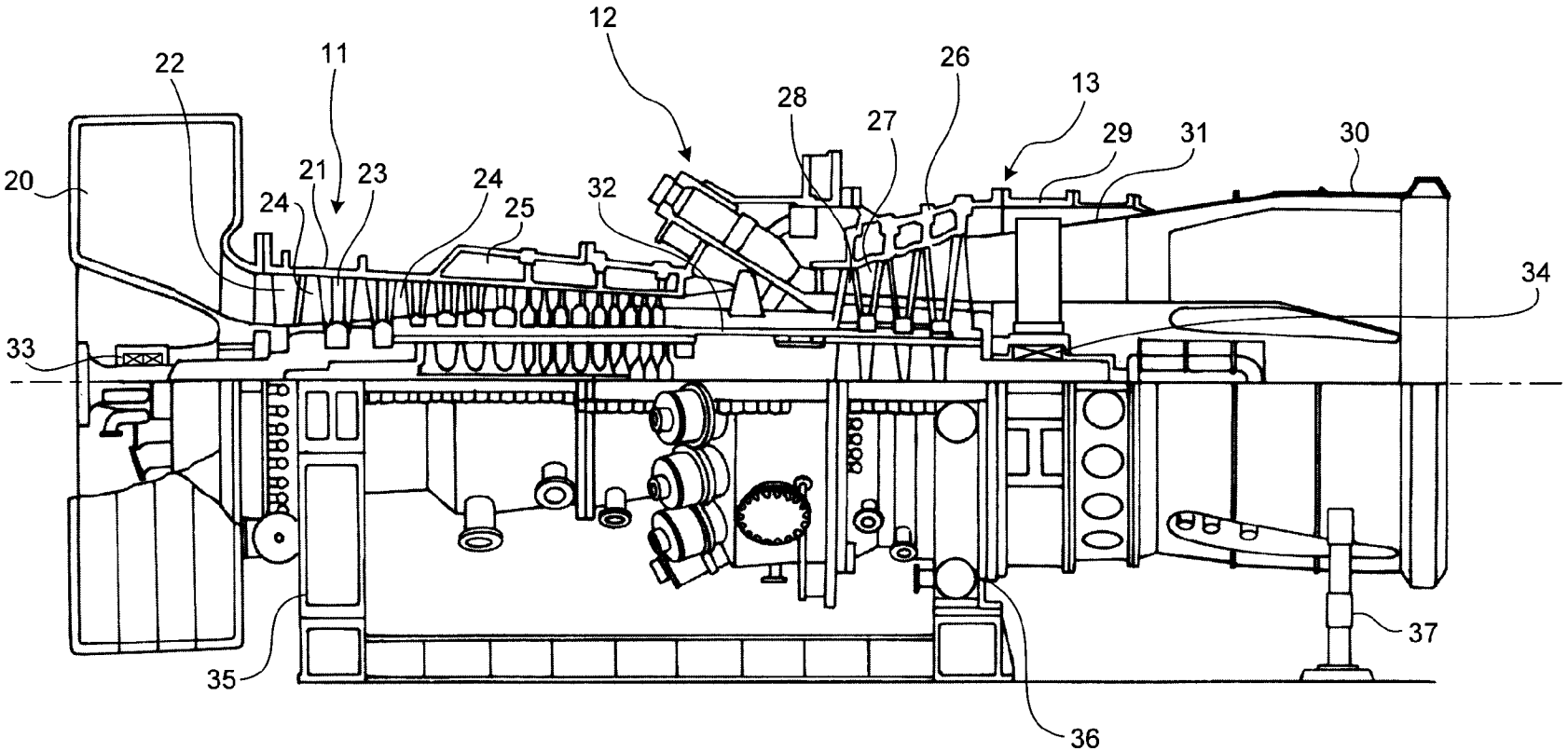
FIG. 4 is a schematic configuration diagram illustrating a gas turbine of the first embodiment.
Figure 5:
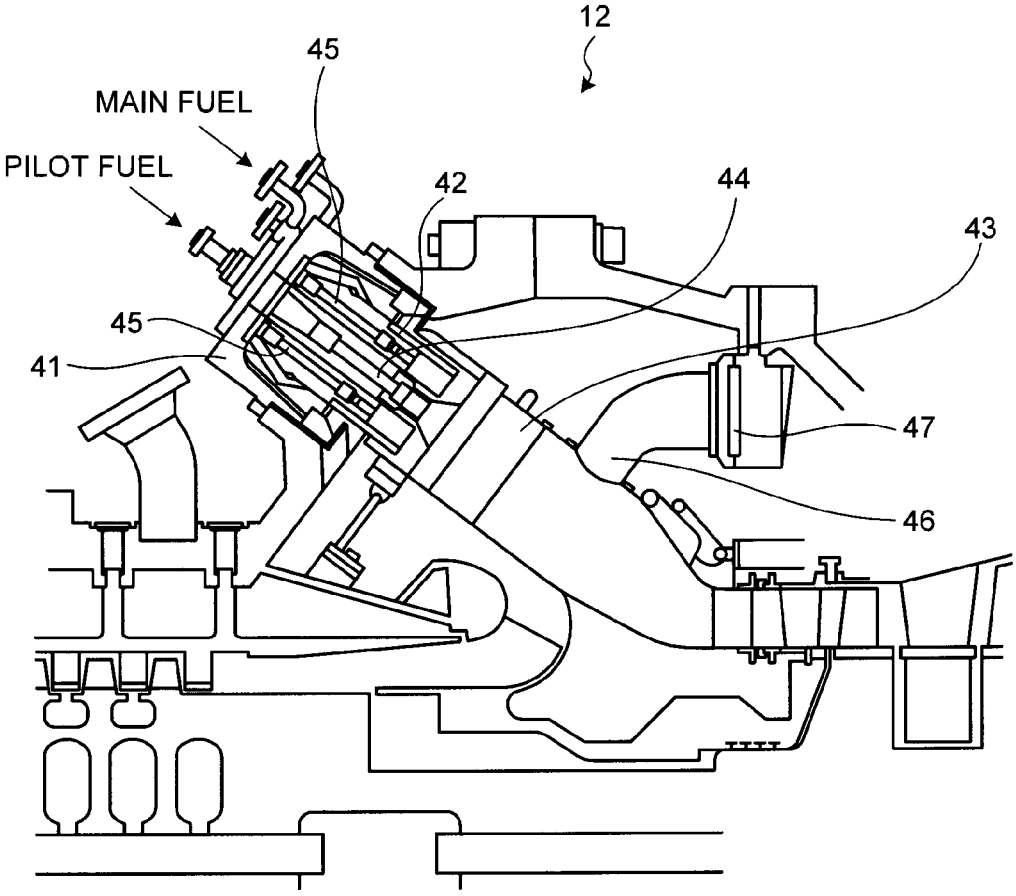
FIG. 5 is a schematic configuration diagram illustrating a gas turbine combustor of the first embodiment.
Figure 6:
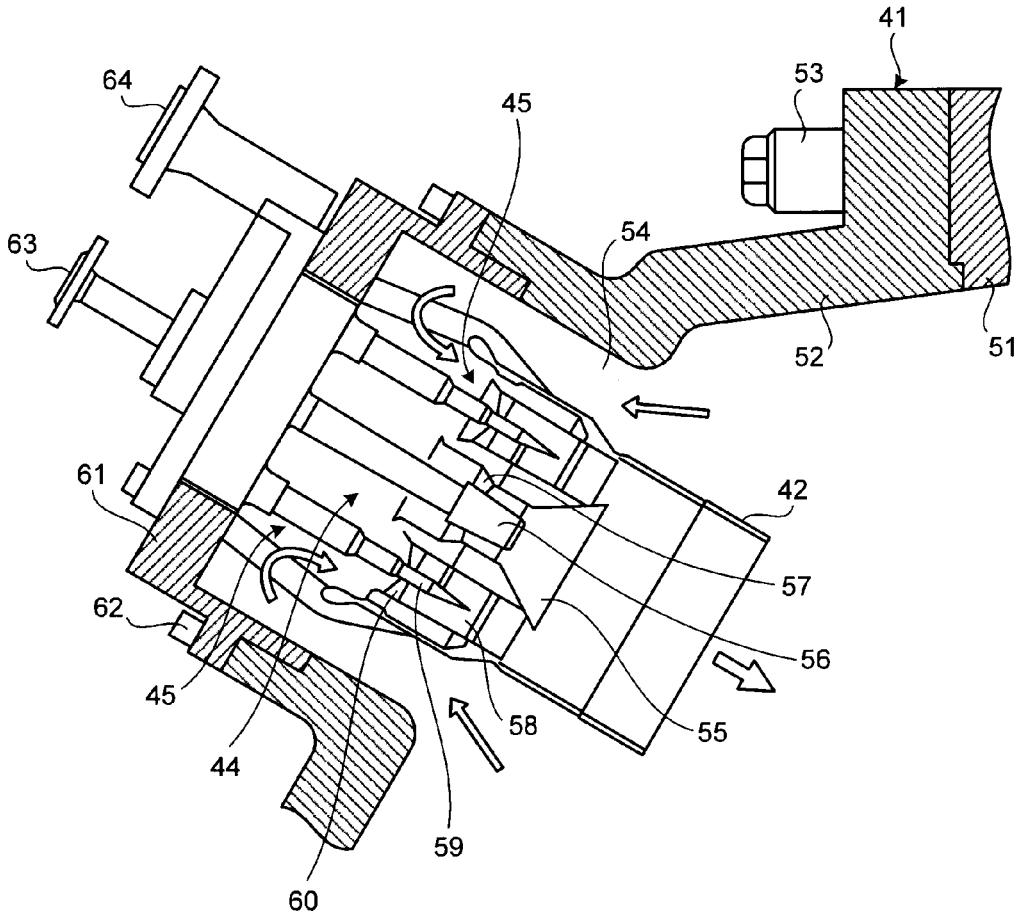
FIG. 6 is a cross-sectional view of major parts in the gas turbine combustor of the first embodiment.

FIG. 1-1 is a cross-sectional view for illustrating a front end portion of a pilot nozzle according to a first embodiment of the present invention at a position where a nozzle tip is provided, FIG. 1-2 is a cross-sectional view illustrating an operation of a guide surface of the pilot nozzle of the first embodiment, FIG. 2 is a cross-sectional view for illustrating the front end portion of the pilot nozzle of the first embodiment at a position where a nozzle tip is not provided, FIG. 3 is a front view illustrating the front end portion of the pilot nozzle of the first embodiment, FIG. 4 is a schematic configuration diagram illustrating a gas turbine of the first embodiment, FIG. 5 is a schematic configuration diagram illustrating a gas turbine combustor of the first embodiment, and FIG. 6 is a cross-sectional view of major parts in the gas turbine combustor of the first embodiment.

As illustrated in FIG. 4, the gas turbine according to the first embodiment includes a compressor 11, a combustor 12, and a turbine 13. A generator (not illustrated) is connected to the gas turbine to generate a power.

The compressor 11 includes an air inlet opening 20 to which air is introduced, and is configured such that an inlet guide vane (IGV) 22 is disposed within a compressor cylinder 21, a plurality of turbine vanes 23 and a plurality of turbine blades 24 are alternately disposed in a forward and backward direction (an axial direction of a rotor 32 to be described below), and a bleed air chamber 25 is provided at an outside thereof. The combustor 12 supplies fuel to a compression air compressed by the compressor 11, and then ignites and combusts the compression air. The turbine 13 is configured such that a plurality of turbine vanes 27 and a plurality of turbine blades 28 are alternately disposed in a forward and backward direction (the axial direction of the rotor 32 to be described below) in a turbine cylinder 26. An exhaust chamber 30 is disposed at a downstream side of the turbine cylinder 26 through an exhaust cylinder 29, and the exhaust chamber 30 includes an exhaust diffuser 31 connected to the turbine 13.

In addition, the rotor (a rotational shaft) 32 is positioned to penetrate through central portions of the compressor 11, the combustor 12, the turbine 13, and the exhaust chamber 30. An end portion of the rotor 32 at a side of the compressor 11 is rotatably supported by a bearing 33, whereas an end portion thereof at a side of the exhaust chamber 30 is rotatably supported by a bearing 34. Further, a plurality of disks each provided with the turbine blade 24 overlap to be fixed to the rotor 32 in the compressor 11, a plurality of disks each provided with the turbine blade 28 overlap to be fixed thereto in the turbine 13, and a driving shaft of a generator (not illustrated) is connected to the end portion thereof at the side of the exhaust chamber 30.

Further, in the gas turbine, the compressor cylinder 21 of the compressor 11 is supported by a leg portion 35, the turbine cylinder 26 of the turbine 13 is supported by a leg portion 36, and the exhaust chamber 30 is supported by a leg portion 37.

Accordingly, the air introduced from the air inlet opening 20 of the compressor 11 passes through the inlet guide vane 22, the plurality of turbine vanes 23 and the plurality of turbine blades 24 to be compressed, and then becomes high-temperature and high-pressure compression air. The combustor 12 supplies a predetermined fuel to the compression air to combust. The high-temperature and high-pressure combustion gas, which is a working fluid generated by the combustor 12, passes through the plurality of turbine vanes 27 and the plurality turbine blades 28 constituting the turbine 13, so that the rotor 32 is driven to rotate, and the generator connected to the rotor 32 is driven. Meanwhile, energy of exhaust gas (combustion gas) is converted into pressure by the exhaust diffuser 31 of the exhaust chamber 30, and then the exhaust gas is reduced in its speed to be discharged to an atmosphere.

As illustrated FIG. 5, in the combustor 12 described above, a combustor casing is configured such that a combustor external cylinder 41 supports a combustor inner cylinder 42 at predetermined intervals therein and a combustor transition piece 43 is connected to a front end portion of the combustor inner cylinder 42. A pilot combustion burner 44 is arranged to be positioned at an inner center of the combustor inner cylinder 42, and a plurality of main combustion burners 45 are arranged at an inner periphery of the combustor inner cylinder 42 in a circumferential direction to surround the pilot combustion burner 44. In addition, a bypass pipe 46 is connected to the transition piece 43, and a bypass valve 47 is provided at the bypass pipe 46.

More particularly, as illustrated in FIG. 6, the combustor external cylinder 41 is configured such that an external cylinder lid portion 52 is closely in contact with a base end portion of an external cylinder main body 51 and is clamped by a plurality of clamping bolts 53. Moreover, a base end portion of the combustor inner cylinder 42 is fittingly inserted into the external cylinder lid portion 52, and an air passage 54 is formed between the external cylinder lid portion 52 and the combustor inner cylinder 42. Further, the pilot combustion burner 44 is arranged to be positioned at the inner center of the combustor inner cylinder 42, and the plurality of main combustion burners 45 are arranged around the pilot combustion burner.

The pilot combustion burner 44 includes a pilot cone 55 supported by the combustor inner cylinder 42, a pilot nozzle 56 arranged within the pilot cone 55, and a swirler vane 57 provided at an outer peripheral portion of the pilot nozzle 56. In addition, the main combustion burner 45 includes a burner cylinder 58, main nozzles 59 arranged within the burner cylinder 58, and swirler vanes 60 provided at outer peripheral portions of the main nozzles 59.

In addition, a top hat portion 61 is fitted into the external cylinder lid portion 52, and is clamped by a plurality of clamping bolts 62. Moreover, fuel ports 63 and 64 are formed at the top hat portion 61. Further, a pilot fuel line (not illustrated) is connected to the fuel port 63 of the pilot nozzle 56, and a main combustion line (not illustrated) is connected to the fuel port 64 for the main nozzles 59.

Accordingly, when an air flow of the high-temperature and high-pressure compression air flows into the air passage 54, the compression air flows into the combustor inner cylinder 42. In the combustor inner cylinder 42, the compression air is mixed with the fuel injected from the main combustion burners 45 to become a swirling flow of the air-fuel pre-mixture, and then the swirling flow flows into the combustor transition piece 43. In addition, the compression air is mixed with the fuel injected from the pilot combustion burner 44, is ignited by a pilot light (not illustrated), and is combusted to become combustion gas. The combustion gas is discharged into the combustor transition piece 43. At this time, some of the combustion gas is discharged to be diffused in surroundings along with a flame within the combustor transition piece 43, so that the air-fuel pre-mixture, which has flowed into the combustor transition piece 43 from each main combustion burner 45, is ignited to be combusted. That is, it is possible to perform flame stabilization for stably combusting lean premixed fuel from the main combustion burners 45 by a diffusion flame generated by pilot fuel injected from the pilot combustion burner 44.

Here, the pilot nozzle 56 of the first embodiment will be described in detail. As illustrated FIGS. 1-1 and 1-2 to FIG. 3, in a front end portion of the pilot nozzle 56, a nozzle main body 71 has a hollow cylindrical shape, and a fuel passage 72 through which the air-fuel mixture (pilot fuel) of the fuel and the compression air flows toward a front end side is formed. A base end portion side of the fuel passage 72 communicates with the fuel port 63 (see FIG. 6), and the front end portion side thereof is clogged.

A cylindrical-shaped sleeve 73 is arranged at an outside of the nozzle main body 71 at a predetermined interval, an air passage 74 is formed in the gap between the nozzle main body 71 and the sleeve 73, and the compressed air (the compression air) can flow toward a front end side of the air passage 74. Further, a cover ring 75 in which a front end side has a cylindrical shape and the front end portion side is bent inward is arranged in the air passage 74.

That is, the nozzle main body 71 includes a cylindrical portion 71*a*, a cone portion 71*b* bent at a predetermined angle to be inclined inward from a front end portion of the cylindrical portion 71*a*, and a disk portion 71*c* for clogging a front end portion of the cone portion 71*b*. In addition, the cover ring 75 has a cylindrical portion 75*a* positioned between the nozzle main body 71 and the sleeve 73, and a cone portion 75*b* bent at a predetermined angle to be inclined inward from a front end portion of the cylindrical portion 75*a* along the front end portion 71*b* of the nozzle main body 71. Further, a plurality of inner spacers 76 are interposed at a predetermined interval in a circumferential direction between the nozzle main body 71 and the cover ring 75, so that a predetermined gap is secured. In addition, an outer spacer 77 is interposed between the cover ring 75 and the sleeve 73, so that a predetermined gap is secured. For this reason, the air passage 74 formed between the nozzle main body 71 and the sleeve 73 branches into an inner air passage 78 and an outer air passage 79 by the cover ring 75.

In addition, a plurality of nozzle tips 80 are fixed to the cone portion 75*b* of the cover ring 75 at a predetermined interval (an equi-interval) in a circumferential direction. Further, a plurality of fuel injection nozzles 81 are formed to penetrate the nozzle tips 80 from the cone portion 71*b* of the nozzle main body 71, and base end portions of the fuel injection nozzles 81 communicate with the fuel passage 72.

For this reason, the cover ring 75 is arranged at an outside of a front end-outer peripheral portion of the nozzle main body 71 with the predetermined gap, so that the inner air passage 78 can be formed between the cover ring and the nozzle main body. Thus, the air can be injected toward a front side of the nozzle main body 71, that is, an inside of the nozzle main body 71. In addition, the plurality of nozzle tips 80 are attached to the front end portion of the cover ring 75 at the predetermined intervals in the circumferential direction, and the fuel injection nozzles 81 communicating with the fuel passage 72 are attached, so that the fuel can be injected toward an outside of the injection air from the inner air passage 78. Furthermore, the sleeve 73 is arranged at an outside of an outer peripheral portion of the cover ring 75 with the predetermined gap, so that the outer air passage 79 can be formed. Thus, the air can be injected toward an outside of the injection fuel from the fuel passage 72.

In addition, the pilot nozzle 56 is provided with a swirling force application unit for applying a swirling force to the air flowing through the inner air passage 78. In the first embodiment, the swirling force application unit is provided as guide portions formed at an outlet of the inner air passage 78, and the guide portions are provided as guide surfaces 82 formed at the plurality of nozzle tips 80.

That is, the plurality of nozzle tips 80 are fixed to the cone portion 75*b* of the cover ring 75 at the equi-interval in the circumferential direction, and the fuel injection nozzles 81 are provided to be positioned at the outer periphery side of the cover ring 75. Further, each nozzle tip 80 is provided with the guide surface 82 which extends toward a central axis line C of the nozzle main body 71 from the cone portion 75*b* of the cover ring 75, and in which a front end portion is positioned at the front side of the outlet of the inner air passage 78 and one end surface side is bent.

Hereinafter, operations of the pilot nozzle 56 and the combustor 12 of the first embodiment will be described.

As illustrated in FIGS. 1-1 and 3, in the pilot nozzle 56, the air-fuel mixture (fuel) F injected from the fuel injection nozzles 81 is ignited by a pilot light (not illustrated), is combusted to become high-temperature combustion gas FG, and then is discharged to be diffused in surroundings along with a flame. Meanwhile, the air flowing through the air passage 74 is divided into a front end cooling air A1 passing through the inner air passage 78 and an outer cooling air A2 passing through the outer air passage 79 by the cover ring 75. Further, since the front end cooling air A1 is guided to an inside of the cover ring 75, a direction of the air is changed to the inside by the cone portion 75*b* to flow and then is injected to an inside of the air-fuel mixture F toward a front side of the disk portion 71*c* of the nozzle main body 71. At this time, as illustrated in FIG. 1-2, the front end cooling air A1 injected from the inner air passage 78 becomes a swirling flow around the central axis line C of the nozzle main body 71 by each guide surface 82 formed at each nozzle tip 80. In addition, since the outer cooling air A2 is guided to an outside of the cover ring 75, the air is injected to an outside of the air-fuel mixture F from an outside of the cone portion 75*b* toward a front side thereof.

Meanwhile, as illustrated in FIG. 6, in the combustor 12, since the air-fuel pre-mixture of the compression air and the fuel injected from the main nozzles 59 becomes a swirling flow by the swirler vane 60, the air-fuel pre-mixture is recirculated to a central portion side from the outer periphery side in the combustor inner cylinder 42 to become a circulatory flow. The circulatory flow flows toward the front end portion side of the pilot nozzle 56. For this reason, the front end cooling air A1, which has been injected from the pilot nozzle 56 to become the circulatory flow, collides with the air-fuel pre-mixture, which has been injected from the main nozzles 59 to become the circulatory flow, at a predetermined position. Here, by appropriately mixing the front end cooling air and the air-fuel pre-mixture, the mixture flows toward the outside to become a flame, so that it is possible to accomplish stabilized combustion.

In this case, since the front end cooling air A1 from the pilot nozzle 56 is the swirling flow, it is possible to stabilize combustion without largely fluctuating an air flow velocity distribution in an axial direction. As a result, by suppressing a temperature rise in the vicinity of the pilot nozzle 56, it is possible to prevent the pilot nozzle 56 from being damaged and to reduce a NOx generation amount.

In this way, the pilot nozzle of the first embodiment includes the nozzle main body 71 having the fuel passage 72, the cover ring 75 that is arranged at the outside of the front end-outer peripheral portion of the nozzle main body 71 with the predetermined gap to form the inner air passage 78 and is capable of injecting the air toward the front side of the nozzle main body 71, the plurality of nozzle tips 80 having the fuel injection nozzles 81 attached to the front end portion of the cover ring 75 at the predetermined interval in the circumferential direction to communicate with the fuel passage 72 and capable of injecting the fuel to the outside of the injection air from the inner air passage 78, and the swirling force application unit for applying the swirling force to the air injected through the inner air passage 78.

Accordingly, since the air injected toward the front side of the nozzle main body 71 from the cover ring 75 through the inner air passage 78 becomes the swirling flow by the swirling force application unit, a cooling air distribution within the pilot cone can be controlled without largely fluctuating the air flow velocity distribution in the axial direction, so that it is possible to stabilize combustion. In addition, by suppressing a temperature rise, it is possible to prevent the front end portion of the pilot nozzle 56 from being damaged, and it is possible to reduce the NOx generation amount. As a result, it is possible to accomplish stabilized combustion.

In the pilot nozzle of the first embodiment, furthermore, the guide surface (guide portion) 82 is formed at the outlet of the inner air passage 78 as a swirling force application unit.

Accordingly, the air injected from the cover ring 75 toward the front side of the nozzle main body 71 can become easily the swirling flow.

Furthermore, in the pilot nozzle of the first embodiment, the guide surfaces 82 are formed at the plurality of nozzle tips 80. Accordingly, it is possible to achieve structure simplification, manufacturing easiness, and cost reduction. In this case, by reducing a passage area of the inner air passage 78 by the guide surfaces 82 formed at the nozzle tips 80, since penetration force of the injection air increases, it is possible to stabilize an air flow amount. In addition, by introducing the air from the pilot nozzle 56, it is possible to prevent a back fire or to prevent the nozzle front end from being damaged.

In addition, in the pilot nozzle of the first embodiment, by arranging the sleeve 73 at the outside of the outer peripheral portion of the cover ring 75 with the predetermined gap to form the outer air passage 79, the air can be injected toward the outside of the injection fuel from the fuel passage 72. Accordingly, the air injected through the inner air passage 78 and the air injected through the outer air passage 79 envelop the injection fuel, so that it is possible to facilitate mixing of the air and the fuel and to maintain a fuel-air ratio at an appropriate value.

In addition, the gas turbine combustor and the gas turbine of the first embodiment include the combustor inner cylinder 42 and the combustor transition piece 43 in which the high-pressure air and the fuel are combusted to generate the combustion gas, the pilot combustion burner 44 arranged in the central portion thereof, and the plurality of main combustion burners 45 arranged to surround the pilot combustion burner 44. Accordingly, in the pilot combustion burner 44, since the air injected from the cover ring 75 toward the front side of the nozzle main body 71 through the inner air passage 78 becomes the swirling flow, even when the air flow amount varies, the cooling air distribution within the pilot cone can be controlled without largely fluctuating the air flow velocity distribution in the axial direction, so that it is possible to stabilize combustion. In addition, a temperature rise in the vicinity of the pilot nozzle can be suppressed by the swirling flow of the cooling air, so that it is possible to prevent the front end portion of the pilot nozzle 56 from being damaged and to reduce the NOx generation amount. As a result, stabilized combustion can be accomplished, so that it is possible to improve turbine efficiency.

Second Embodiment

Figure 7:
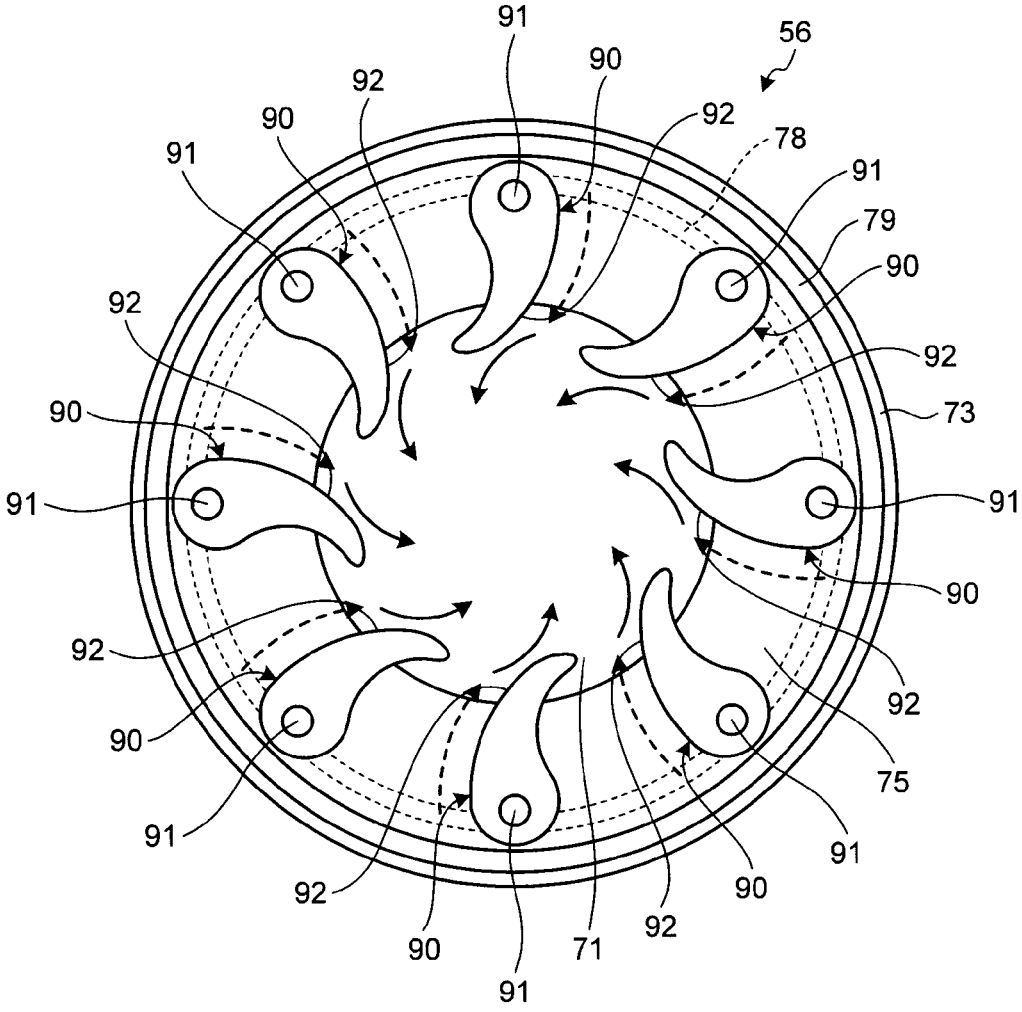
FIG. 7 is a schematic front view illustrating a front end portion of a pilot nozzle according to a second embodiment of the present invention.

FIG. 7 is a schematic front view illustrating a front end portion of a pilot nozzle according to a second embodiment of the present invention. The pilot nozzle of the present embodiment has the substantially same basic configuration to that in the first embodiment described above, and will be described with reference to FIGS. 1 and 2. Components having the same functions as those in the aforementioned embodiment will be assigned with the same reference numerals, and the detailed descriptions thereof will not be presented.

In the second embodiment, as illustrated in FIGS. 1 and 2, and FIG. 7, in the pilot nozzle 56, a plurality of nozzle tips 90 are fixed to the cone portion 75*b* of the cover ring 75 at a predetermined interval (an equi-interval) in a circumferential direction. Further, a plurality of fuel injection nozzles 91 are provided to penetrate through the nozzle tips 90 from the cone portion 71*b* of the nozzle main body 71, and a base end portion of each fuel injection nozzle 91 communicates with the fuel passage 72.

For this reason, by arranging the cover ring 75 at the outside of the front end-outer peripheral portion of the nozzle main body 71 with the predetermined gap, the inner air passage 78 can be formed between the cover ring and the nozzle main body, so that the air can be injected toward the front side of the nozzle main body 71, that is, the inside of the nozzle main body 71. In addition, the plurality of nozzle tips 90 are attached to the front end portion of the cover ring 75 at the predetermined interval in the circumferential direction, and the fuel injection nozzles 91 communicating with the fuel passage 72 are attached, so that the fuel can be injected toward the outside of the injection air from the inner air passage 78. Furthermore, by arranging the sleeve 73 at the outside of the outer peripheral portion of the cover ring 75 with the predetermined gap, the outer air passage 79 can be formed, so that the air can be injected toward the outside of the injection fuel from the fuel passage 72.

In addition, the pilot nozzle 56 is provided with a swirling force application unit for applying a swirling force to the air flowing through the inner air passage 78. In the second embodiment, the swirling force application unit is provided as guide portions formed at an outlet of the inner air passage 78, and the guide portion is provided as guide surfaces 92 formed at the plurality of nozzle tips 90.

That is, the plurality of nozzle tips 90 are fixed to the cone portion 75*b* of the cover ring 75 at the equi-interval in the circumferential direction, and the fuel injection nozzle 91 is provided to be positioned at the outer periphery side of the cover ring 75. Further, each nozzle tip 90 is provided with the guide surface 92, which has a blade shape as a whole, and extends toward the central axis line C of the nozzle main body 71 from the cone portion 75*b* of the cover ring 75, and in which a front end portion is positioned at the front side of the outlet of the inner air passage 78 and one end surface is bent.

Accordingly, in the pilot nozzle 56, an air-fuel mixture injected from the fuel injection nozzles 91 is combusted to become high-temperature combustion gas FG and is discharged from to be diffused in surroundings along with a flame. Meanwhile, the air passing through the air passage 74 is divided into a front end cooling air A1 passing through the inner air passage 78 and an outer cooling air A2 passing through the outer air passage 79 by the cover ring 75. Further, the front end cooling air A1 of the inside becomes a swirling flow around the central axis line C of the nozzle main body 71 by each guide surface 92 formed at each nozzle tip 90. Further, an air-fuel pre-mixture of the compression air and the fuel injected from the main nozzles 59 is re-circulated to a central portion side to become a circulatory flow and flows toward a front end portion side of the pilot nozzle 56. For this reason, the front end cooling air A1, which has been injected from the pilot nozzle 56 to become the swirling flow, and the air-fuel pre-mixture, which has been injected from the main nozzles 59 to become a circulatory flow, collide at a predetermined position. Here, by appropriately mixing the front end cooling air and the air-fuel pre-mixture, the mixture flows toward the outside to become a flame, so that it is possible to accomplish stabilized combustion.

That is, since the front end cooling air A1 from the pilot nozzle 56 is the swirling flow, a cooling air distribution in the pilot cone can be controlled without largely fluctuating an air flow velocity distribution in an axial direction, so that it is possible to stabilize combustion. In addition, since a temperature rise in the vicinity of the pilot nozzle can be suppressed by the swirling flow of the cooling air, it is possible to prevent the pilot nozzle 56 from being damaged and to reduce a NOx generation amount.

In this way, the pilot nozzle of the second embodiment is provided with the swirling force application unit for applying the swirling force to the air injected through the inner air passage 78, and the guide surfaces 92 are formed at the plurality of nozzle tips 90 as the swirling force application unit.

Accordingly, since the air injected from the cover ring 75 toward the front side of the nozzle main body 71 through the inner air passage 78 becomes the swirling flow by the guide surfaces 92 of the nozzle tips 90, a temperature rise in the vicinity of the pilot nozzle can be suppressed, so that it is possible to prevent the front end portion of the pilot nozzle 56 from being damaged and to reduce a NOx generation amount. As a result, it is possible to accomplish stabilized combustion.

Third Embodiment

Figure 8:
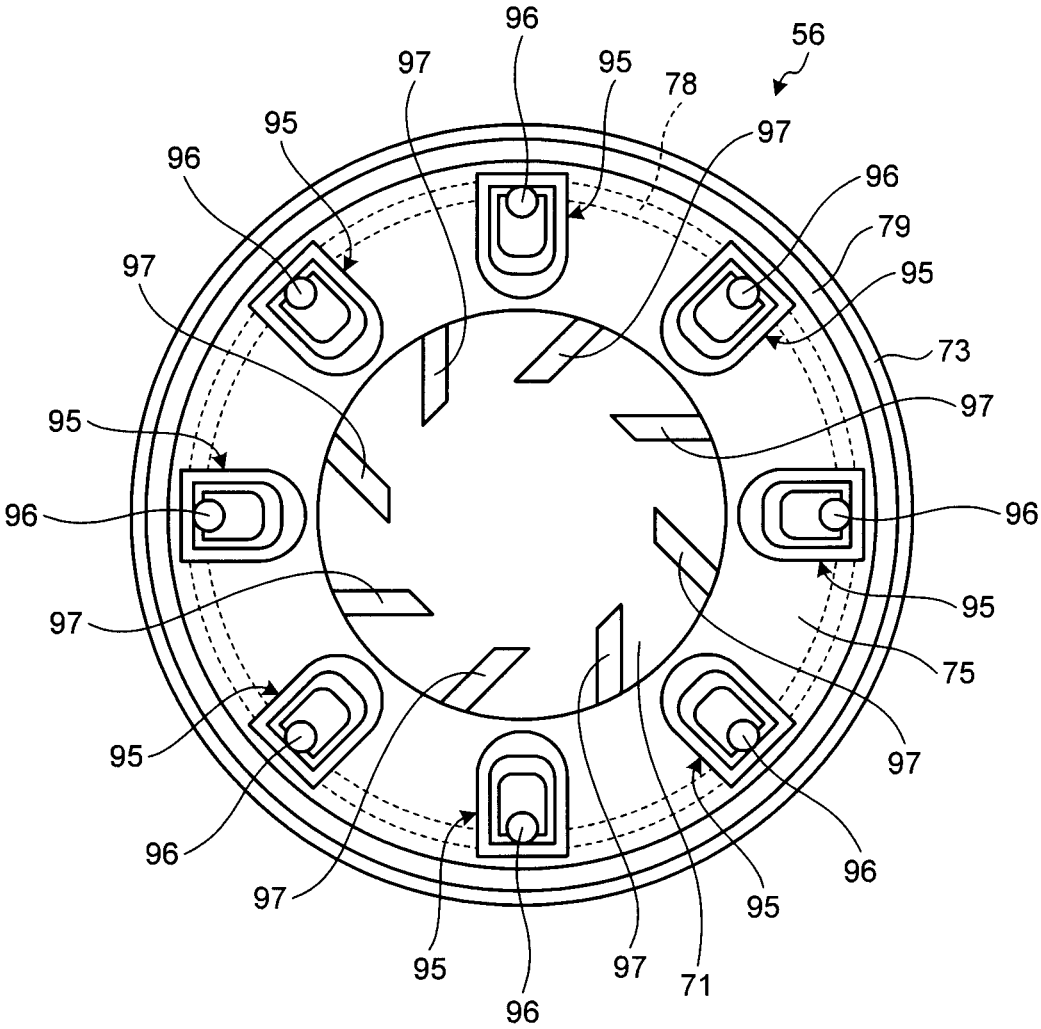
FIG. 8 is a front view illustrating a front end portion of a pilot nozzle according to a third embodiment of the present invention.

FIG. 8 is a front view illustrating a front end portion of a pilot nozzle according to a third embodiment of the present invention. The pilot nozzle of the present embodiment has the substantially same basic configuration to that in the first embodiment described above, and will be described with reference to FIGS. 1 and 2. Components having the same functions as those in the aforementioned embodiment will be assigned with the same reference numerals, and the detailed description thereof will not be presented.

As illustrated in FIGS. 1 and 2, and FIG. 8, in the pilot nozzle 56 of the third embodiment, a plurality of nozzle tips 95 are fixed to the cone portion 75*b* of the cover ring 75 at a predetermined interval (an equi-interval) in a circumferential direction. Further, a plurality of fuel injection nozzles 96 are provided to penetrate through the nozzle tips 95 from the cone portion 71*b* of the nozzle main body 71, and a base end portion of each fuel injection nozzle 96 communicates with the fuel passage 72.

For this reason, by arranging the cover ring 75 at an outside of a front end-outer peripheral portion of the nozzle main body 71 at a predetermined interval, the inner air passage 78 can be formed between the cover ring and the nozzle main body, so that the air can be injected toward the front side of the nozzle main body 71, that is, the inside of the nozzle main body 71. In addition, the plurality of nozzle tips 95 is attached to the front end portion of the cover ring 75 at a predetermined interval in the circumferential direction, and the fuel injection nozzles 96 communicating with the fuel passage 72 are attached, so that the fuel can be injected toward the outside of the injection air from the inner air passage 78. Furthermore, by arranging the sleeve 73 at an outside of an outer peripheral portion of the cover ring 75 at a predetermined interval, the outer air passage 79 can be formed, so that the air can be injected toward the outside of the injection fuel from the fuel passage 72.

In addition, the pilot nozzle 56 is provided with a swirling force application unit for applying a swirling force to the air flowing through the inner air passage 78. In the third embodiment, the swirling force application unit is provided as guide portions formed at an outlet of the inner air passage 78, and the guide portions are provided as a plurality of swirler vanes 97 formed at positions of the cover ring 75 so as not to be positioned at the same row as the plurality of nozzle tips 95 in a diameter direction and in a circumferential direction.

That is, the plurality of nozzle tips 95 is fixed to the cone portion 75*b* of the cover ring 75 at the equi-interval in the circumferential direction, and the fuel injection nozzles 96 are provided to be positioned at the outer periphery side of the cover ring 75. Meanwhile, the swirler vanes 97 have a blade shape as a whole, are directed to the central axial line C of the nozzle main body 71 from the cone portion 75*b* of the cover ring 75, and are fixed to protrude in a direction inclined at a predetermined angle with a radial direction.

Accordingly, in the pilot nozzle 56, the air-fuel mixture F injected from the fuel injection nozzles 96 is combusted to become the high-temperature combustion gas FG, and then is discharged to be diffused in surroundings along with the flame. Meanwhile, the air passing through the air passage 74 is divided into the front end cooling air A1 passing through the inner air passage 78 and the outer cooling air passing through the outer air passage 79 by the cover ring 75. Further, the front end cooling air A1 of the inside becomes the swirling flow around the central axial line C of the nozzle main body 71 by each swirler vane 97. Further, the air-fuel pre-mixture of the compression air and the fuel injected from the main nozzles 59 is re-circulated toward the central portion to become the circulatory flow, and flows toward the front end portion side of the pilot nozzle 56. For this reason, the front end cooling air A1, which has been injected from the pilot nozzle 56 to become the circulatory flow, collides with the air-fuel pre-mixture, which has been injected from the main nozzles 59 to become the circulatory flow, at a predetermined position. Here, by appropriately mixing the front end cooling air and the air-fuel pre-mixture, the mixture flows toward the outside to become a flame, so that it is possible to accomplish stabilized combustion.

That is, since the front end cooling air A1 from the pilot nozzle 56 is the swirling flow, the cooling air distribution within the pilot cone can be controlled without largely fluctuating an air flow velocity distribution in an axial direction, so that it is possible to stabilize combustion. As a result, by suppressing a temperature rise in the vicinity of the pilot nozzle 56, it is possible to prevent the pilot nozzle 56 from being damaged and to reduce a NOx generation amount.

In this way, the pilot nozzle of the third embodiment is provided with the swirling force application unit for applying the swirling force to the air flowing through the inner air passage 78, and the swirling force application unit is provided as the plurality of swirler vanes 97 formed at positions of the cover ring 75 so as not to be positioned at the same row as the plurality of nozzle tips 95 in the circumferential direction.

Accordingly, since the air injected from the cover ring 75 toward the front side of the nozzle main body 71 through the inner air passage 78 becomes the swirling flow by the swirler vanes 97, even when the air flow amount is varied, the cooling air distribution within the pilot cone can be controlled without largely fluctuating the air flow velocity distribution in the axial direction, so that it is possible to stabilize combustion. In addition, a temperature increase can be suppressed, so that it is possible to prevent the front end portion of the pilot nozzle 56 from being damaged and to reduce the NOx generation amount. As a result, stabilized combustion can be accomplished. In addition, since the nozzle tips 95 and the swirler vanes 97 face each other in a diameter direction, it is possible to facilitate mixing of the swirling flow of the air injected from the cover ring 75 and the fuel injected from the nozzle tips 95.

Although it has been described in the third embodiment that the plurality of swirler vanes 97 are provided at positions of the cover ring 75 so as not to be positioned at the same row as the plurality of nozzle tips 95 in the circumferential direction as the swirling force application unit, the providing positions are not limited thereto. The plurality of swirler vanes 97 may be provided at positions of the cover ring 75 facing the plurality of nozzle tips 95 in a diameter direction as long as the plurality of swirler vanes do not interfere in the nozzle tips 95 or do not adversely affect the injection fuel.

In addition, although the aforementioned embodiments have been described that the swirling force application unit is provided as the guide surfaces 82 and 92, or the swirler vanes 97 formed at the nozzle tips 80 and 90 formed at the outlet of the inner air passage 78, the providing position is not limited to the outlet of the inner air passage 78. The guide portion may be provided within the inner air passage 78. In addition, the shapes of the nozzle tips 80 and 90, the guide surfaces 82 and 92, and the swirler vanes 97 are not limited the aforementioned embodiments. Any shape may be used as long as the swirling force can be applied to the air injected through the inner air passage 78.

In addition, although it has been described in the above-described embodiments that the fuel injection nozzles 81, 91, and 96 are provided at the nozzle tips 80, 90, and 95, and the guide portions 82 and 92 are provided at the nozzle tips 80, 90, and 95, the present invention is not limited to these configurations. For example, the fuel injection nozzles and the guide surfaces may be provided at the nozzle main body 71.

REFERENCE SIGNS LIST

11 COMPRESSOR
12 COMBUSTOR
13 TURBINE
41 COMBUSTOR EXTERNAL CYLINDER
42 COMBUSTOR INNER CYLINDER (COMBUSTION CHAMBER)
43 COMBUSTOR TRANSITION PIECE
44 PILOT COMBUSTION BURNER
45 MAIN COMBUSTION BURNER
55 PILOT CONE
56 PILOT NOZZLE (NOZZLE)
57 SWIRLER VANE
71 NOZZLE MAIN BODY
72 FUEL PASSAGE
73 SLEEVE
75 COVER RING
78 INNER AIR PASSAGE
79 OUTER AIR PASSAGE
80, 90, 95 NOZZLE TIP
81, 91, 96 FUEL INJECTION NOZZLE
82, 92 GUIDE SURFACE (SWIRLING FORCE APPLICATION UNIT, GUIDE PORTION)
97 SWIRLER VANE (SWIRLING FORCE APPLICATION UNIT, GUIDE PORTION)

The invention claimed is:

1. A nozzle, comprising:
a nozzle main body having a fuel passage;
a cover ring arranged at an outside of a front end-outer peripheral portion of the nozzle main body at a predetermined interval to form an inner air passage, for injecting air toward a front side of the nozzle main body;
fuel injection nozzles, each disposed within a nozzle tip, each nozzle tip having an outer surface attached to an inner surface of a front end portion of the cover ring at a predetermined interval in a circumferential direction to communicate with the fuel passage; and
a swirling force application unit provided at an outlet of the inner air passage so as to apply a circumferential swirling force to air injected through the inner air passage.

2. The nozzle according to claim 1, wherein the swirling force application unit has guide portions provided at an outlet of the inner air passage.

3. The nozzle according to claim 2, wherein the fuel injection nozzles are provided at a plurality of nozzle tips for injecting fuel to an outside of injection air from the inner air passage, and the guide portions are provided at the plurality of nozzle tips.

4. The nozzle according to claim 1, wherein guide portions are provided so as not to be positioned at the same row as the plurality of nozzle tips of the cover ring in the circumferential direction.

5. The nozzle according to claim 1, wherein a sleeve is arranged at an outside of an outer peripheral portion of the cover ring at a predetermined interval to form an outer air passage and is configured to inject air toward an outside of injection fuel from the fuel passage.

6. A gas turbine combustor, comprising:
a combustion chamber for combusting high-pressure air and fuel therein to generate combustion gas;
a pilot combustion burner arranged at a central portion within the combustion chamber; and
a plurality of main combustion burners arranged to surround the pilot combustion burner within the combustion chamber, wherein
the pilot combustion burner includes:
a pilot cone;
a pilot nozzle arranged within the pilot cone; and
a swirler vane provided at an outer peripheral portion of the pilot nozzle; and
the pilot cone includes:
a nozzle main body having a fuel passage;
a cover ring arranged at an outside of a front end-outer peripheral portion of the nozzle main body at a predetermined interval to form an inner air passage, for injecting air toward a front side of the nozzle main body;
fuel injection nozzles, each disposed within a nozzle tip, each nozzle tip having an outer surface attached to an inner surface of a front end portion of the cover ring at a predetermined interval in a circumferential direction to communicate with the fuel passage; and
a swirling force application unit provided at an outlet of the inner air passage so as to apply a circumferential swirling force to air flowing through the inner air passage.

7. A gas turbine comprising:
a compressor for compressing air so as to generate compressed air;
a combustor for combusting the compressed air and fuel so as to generate combustion gas; and
a turbine for obtaining a rotational driving force with the generated combustion gas, wherein
the combustor includes:
a combustion chamber for combusting high-pressure air and fuel therein to generate combustion gas;
a pilot combustion burner arranged at a central portion within the combustion chamber; and
a plurality of main combustion burners arranged to surround the pilot combustion burner within the combustion chamber,
the pilot combustion burner includes:
a pilot cone;
a pilot nozzle arranged within the pilot cone; and
a swirler vane provided at an outer peripheral portion of the pilot nozzle, and
the pilot cone includes:
a nozzle main body having a fuel passage;
a cover ring arranged at an outside of a front end-outer peripheral portion of the nozzle main body at a predetermined interval to form an inner air passage, for injecting air toward a front side of the nozzle main body;
fuel injection nozzles, each disposed within a nozzle tip, each nozzle tip having an outer surface attached to an inner surface of a front end portion of the cover ring at a predetermined interval in the circumferential direction to communicate with the fuel passage; and a swirling force application unit provided at an outlet of the inner air passage so as to apply a circumferential swirling force to air flowing through the inner air passage.

8. A nozzle, comprising:

a nozzle main body having a fuel passage;

a cover ring that is arranged at an outside of a front end-outer peripheral portion of the nozzle main body via inner spacers and defines an inner air passage through which inner air is injected toward a front side of the nozzle main body;

a plurality of nozzle chips, each having an outer surface attached to an inner surface of a front end portion of the cover ring at predetermined intervals in a circumferential direction of the cover ring, each of the plurality of nozzle chips having a hole communicating to the fuel passage;

plurality of nozzles that are provided for the plurality of nozzle chips, respectively, and communicate with the fuel passage via the holes, respectively, wherein each of the plurality of nozzle chips has a guide surface that is bent toward a central axis of the nozzle main body so as to apply a swirling force to the inner air.

* * * * *